US008333374B1

(12) United States Patent
Su

(10) Patent No.: US 8,333,374 B1
(45) Date of Patent: Dec. 18, 2012

(54) PAPER FEEDING APPARATUS WITH UNIDIRECTIONAL ENGAGING MEMBER

(75) Inventor: Liang-Ching Su, New Taipei (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/240,263

(22) Filed: Sep. 22, 2011

(30) Foreign Application Priority Data

May 25, 2011 (TW) ..... 100118238

(51) Int. Cl.
*B65H 3/06* (2006.01)

(52) U.S. Cl. ..... 271/109; 271/902

(58) Field of Classification Search ..... 271/109, 271/116, 10.13, 902, 272; 192/46
See application file for complete search history.

(56) References Cited

U.S. PATENT DOCUMENTS 5,897,111 A * 4/1999 Jean et al. ..... 271/4.08
5,971,386 A * 10/1999 Jean et al. ..... 271/4.08
6,390,467 B1 * 5/2002 Fukube ..... 271/256
6,578,840 B1 * 6/2003 Kudo ..... 271/10.13
7,185,747 B2 * 3/2007 Cha ..... 192/46
7,600,935 B2 * 10/2009 Koba et al. ..... 400/579
8,132,807 B2 * 3/2012 Androsyuk et al. ..... 271/116
2008/0012200 A1 * 1/2008 Lin et al. ..... 271/10.13

* cited by examiner

*Primary Examiner* — Jeremy R Severson
(74) *Attorney, Agent, or Firm* — Altis Law Group, Inc.

(57) ABSTRACT

A paper-feeding mechanism for a printing apparatus includes a delay engaging member and an unidirectional engaging member. The delay engaging member has a first gear and a first coupling member installed on the first gear. The first coupling member rotates relative to the first gear. The unidirectional engaging member has a third gear installed on the first coupling member. When a sheet of paper is pulled out along a first direction, the first gear rotates along a second direction that is opposite to the first direction. The first coupling member rotates along the second direction together with the first gear. The first gear stops rotating. The third gear and the first coupling member rotate along the second direction until the paper(s) caught in the printing apparatus are pulled out.

20 Claims, 5 Drawing Sheets

PAPER FEEDING APPARATUS WITH UNIDIRECTIONAL ENGAGING MEMBER

BACKGROUND

1. Technical Field

The present disclosure relates to paper transmitting mechanisms, and particularly to a paper-feeding mechanism for printing apparatuses.

2. Description of Related Art

Generally, a printing apparatus, such as a printer or a photocopying machine, feeds a sheet of paper, prints a desired image on the paper, and discharges the printed paper to a tray which is used to carry the printed paper thereon. In most office environments, a single printing apparatus is used by a plurality of users. Paper sheets may sometimes be caught in the paper transmitting gears of the printing apparatus. When users pull the caught papers out of the printing apparatus, the caught papers tend to tear as being engaged with the paper transmitting gears. The torn papers and pieces of them stay in the printing apparatus and are difficult to remove, and the printing apparatus malfunctions.

Therefore there is a need for improvement in the art.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
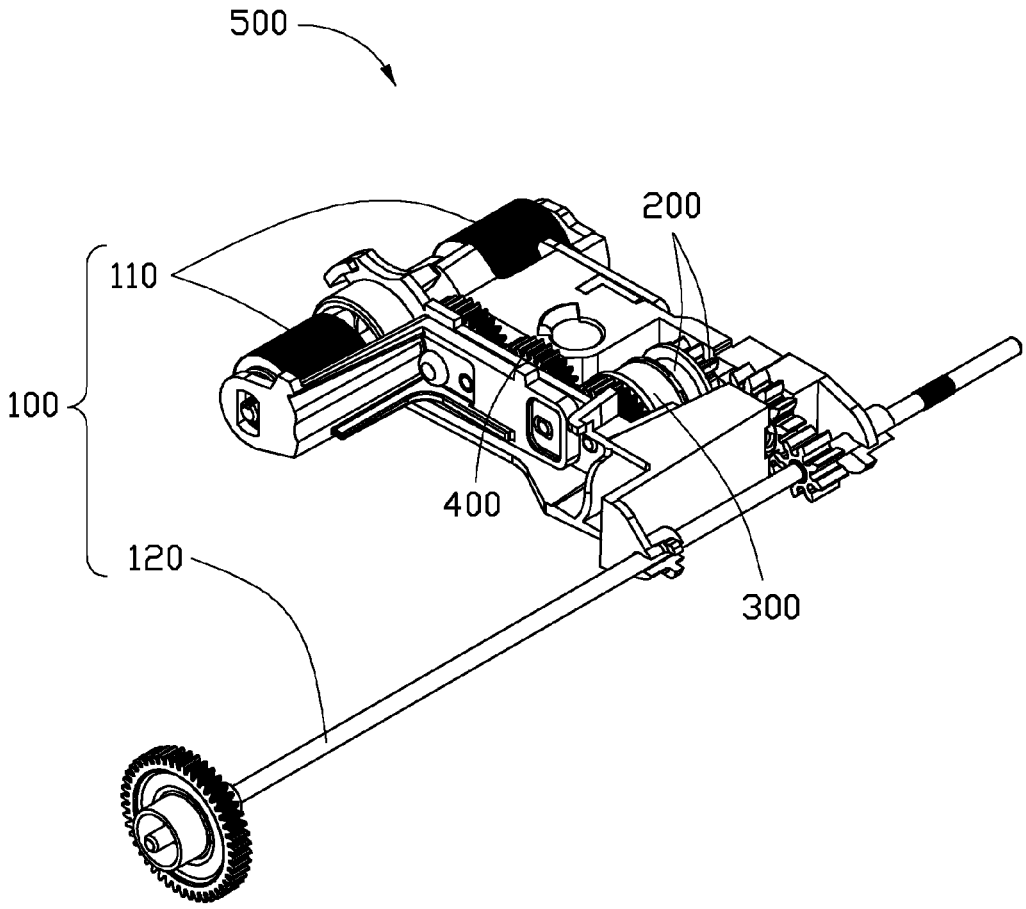
FIG. 1 is an isometric view of a paper-feeding mechanism for a printing apparatus, in accordance with an embodiment.
Figure 2:
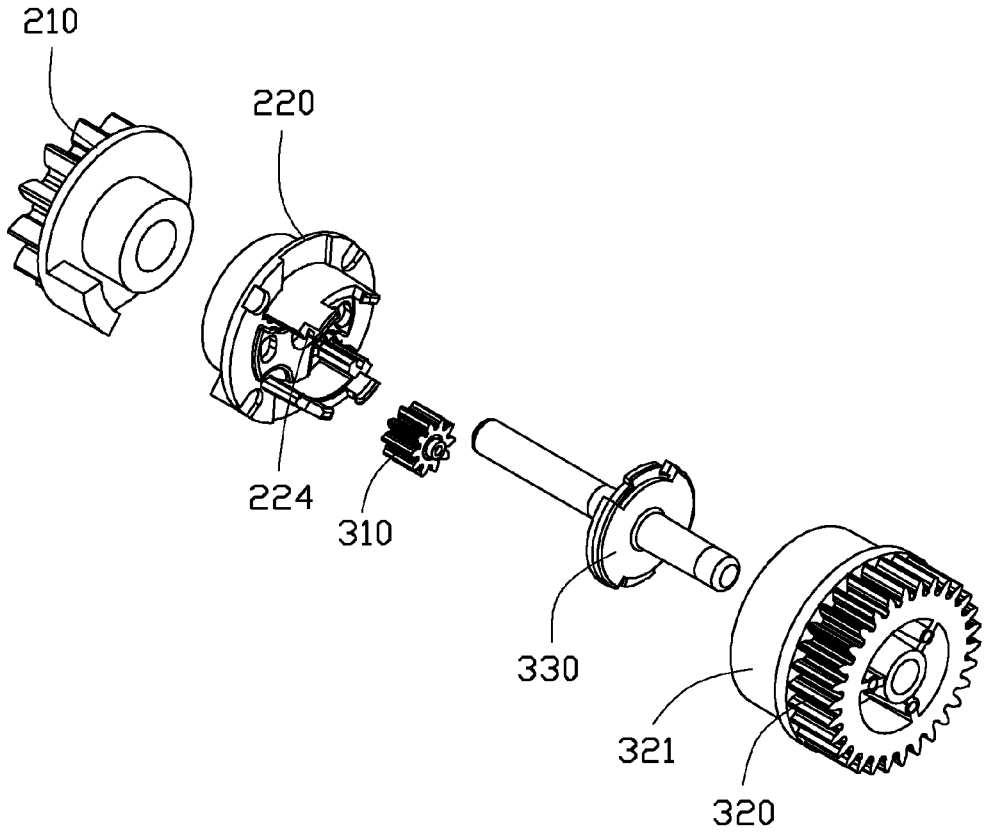
FIG. 2 is an exploded and isometric view of the delay engaging member and the unidirectional engaging member of FIG. 1.
Figure 3:
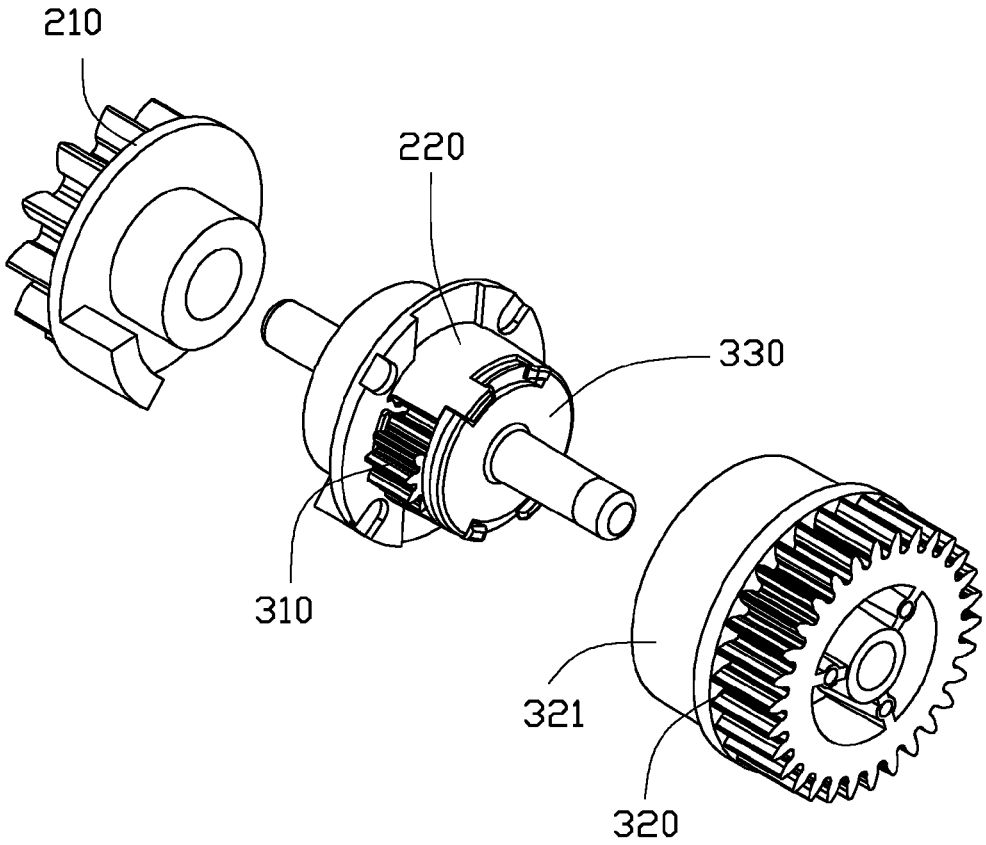
FIG. 3 is a view of the assembled devices of FIG. 2.
Figure 4:
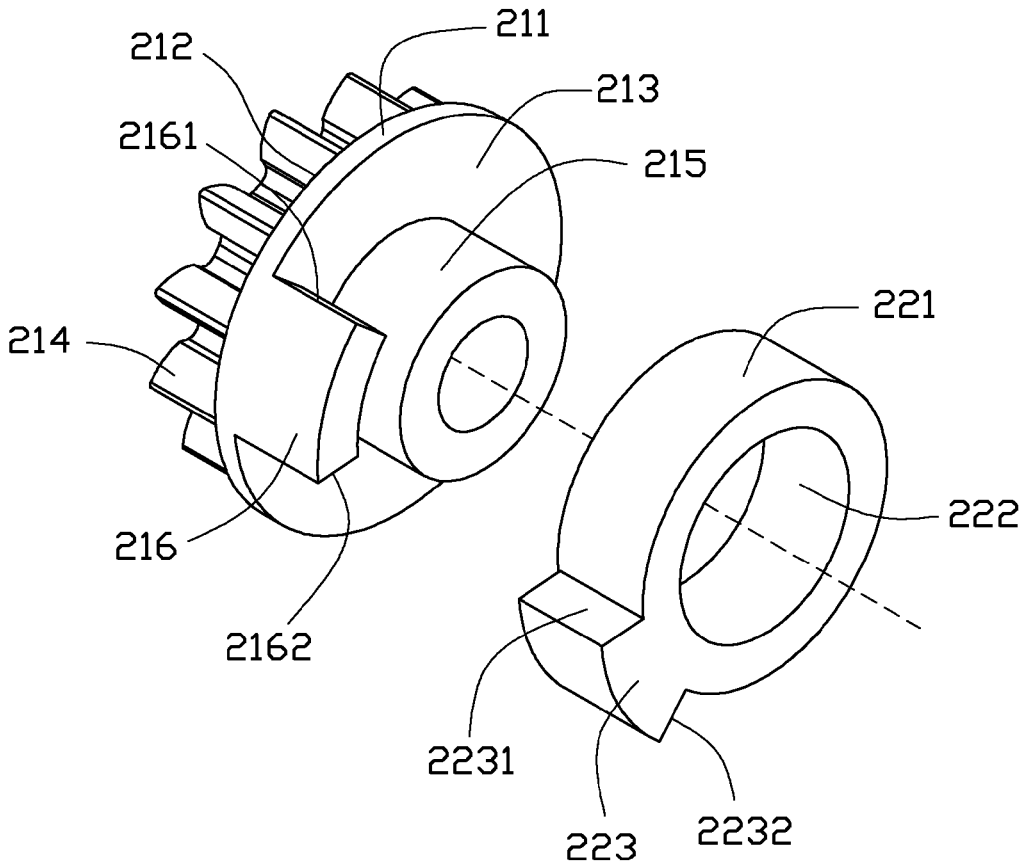
FIG. 4 is an exploded and isometric view of the first gear and the first coupling member of FIG. 2, which are in a first state.
Figure 5:
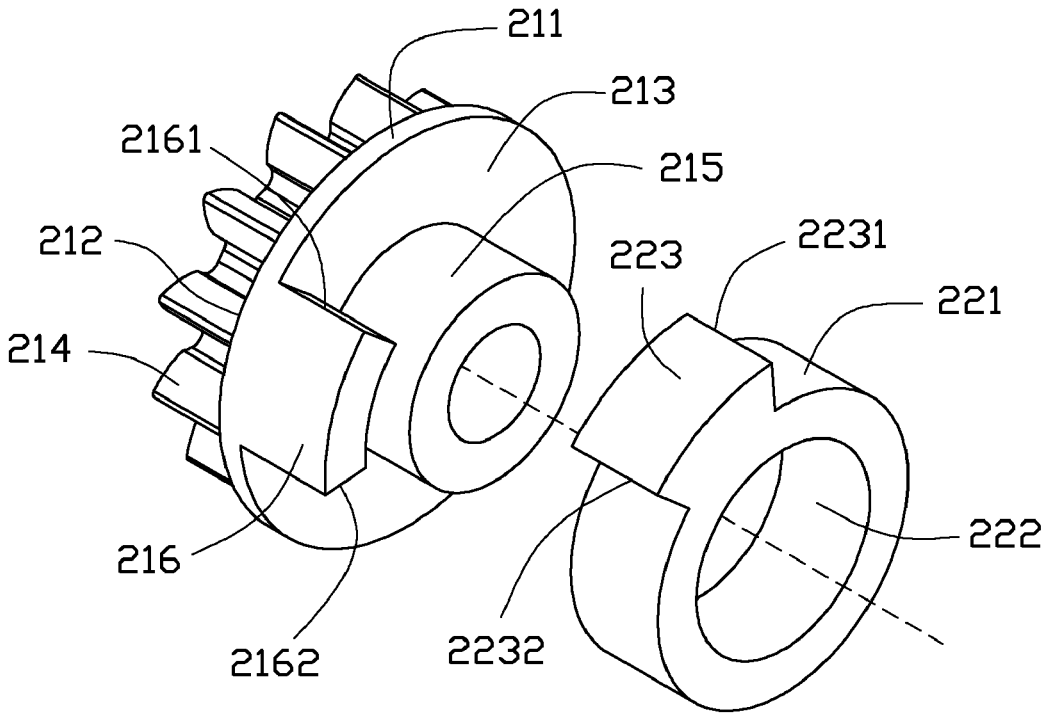
FIG. 5 is an exploded and isometric view of the first gear and the first coupling member of FIG. 2, which are in a second state.

Referring to FIGS. 1 and 2, a paper-feeding mechanism is used to prevent papers being caught inside a printing apparatus 500. The paper-feeding mechanism includes a paper feeding member 100, a delay engaging member 200 and a unidirectional engaging member 300. The paper feeding member 100 includes two paper feeding wheels 110 and a driving gear 120. When the printing apparatus 500 is working normally, the driving gear 120 rotates counterclockwise and drives the two paper feeding wheels 110 in a clockwise direction, via the delay engaging member 200, the unidirectional engaging member 300 and a plurality of transmitting gears 400.

Referring to FIGS. 2 to 5, the delay engaging member 200 includes a first gear 210 and a first coupling member 220. The first coupling member 220 is capable of rotating relative to the first gear 210. The unidirectional engaging member 300 includes a second gear 310 installed on the first coupling member 220, a third gear 320, and a second coupling member 330 which is installed between the first coupling member 220 and the third gear 320. The first coupling member 220 defines a slot 224 thereon for engaging with the second gear 310. The third gear 320 includes a transmitting portion 321 on one end. The transmitting portion 321 defines a plurality of first teeth (not shown) on an inner side for engaging with the second gear 310.

The first gear 210 includes a circular first body member 211. The first body member 211 includes a first surface 212 and a second surface 213 opposite to the first surface 212. A plurality of second teeth 214 protrude from the first surface 212. A ring-shaped rotating portion 215 extends from the second surface 213. A first protrusion block 216 extends from the second surface 213 on one side of the rotating portion 215. The first protrusion block 216 includes a first side 2161 and a second side 2162 opposite to the first side 2161.

The first coupling member 220 includes a ring-shaped second body member 221. The second body member 221 defines a hollow cavity 222 therein. The cavity 222 is capable of accommodating the rotating portion 215. A second protrusion block 223 extends from one side of the second body member 221. The second protrusion block 223 includes a third side 2231 and a fourth side 2232 opposite to the third side 2231. The first coupling member 220 rotates relative to the first gear 210 when the rotating portion 215 is received in the cavity 222.

When the first gear 210 rotates counterclockwise until the second side 2162 abuts the third side 2231, the second protrusion block 223 is pushed around by block 216. The first coupling member 220 rotates counterclockwise together with the first gear 210. When the first gear 210 rotates clockwise until the first side 2161 abuts the fourth side 2232, the second protrusion block 223 is again pushed around. The first coupling member 220 rotates clockwise together with the first gear 210.

The first coupling member 220 is engaged with the third gear 320 in an exclusive counterclockwise direction. When the first gear 210 and the first coupling member 220 rotate counterclockwise, the slot 224 on the first coupling member 220 engages with the second gear 310. The second gear 310 rotates counterclockwise together with the first gear 210 and the first coupling member 220. The second gear 310 engages with the plurality of first teeth on the transmitting portion 321. The third gear 320 rotates counterclockwise together with the second gear 310. When the first gear 210 and the first coupling member 220 rotate clockwise, the slot 224 on the first coupling member 220 is not able to engage with the second gear 310. The second gear 310 cannot be rotated clockwise together with the first gear 210 and the first coupling member 220. The second gear 310 cannot engage with the plurality of first teeth on the transmitting portion 321. The third gear 320 cannot be rotated clockwise.

When the third gear 320 rotates clockwise, the third gear 320 engages with the second gear 310. The second gear 310 rotates clockwise together with the third gear 320. The second gear 310 engages with the slot 224 on the first coupling member 220. The first gear 210 and the first coupling member 220 rotate clockwise together with the second gear 310. When the third gear 320 rotates counterclockwise, the third gear 320 engages with the second gear 310. The second gear 310 rotates counterclockwise together with the third gear 320. The second gear 310 cannot engage with the slot 224 on the first coupling member 220. The first gear 210 and the first coupling member 220 cannot be rotated counterclockwise together with the second gear 310.

When the printing apparatus 500 is working normally, the driving gear 120 rotates counterclockwise and drives the first gear 210 to rotate counterclockwise via the plurality of transmitting gears 400. The first gear 210 rotates counterclockwise until the second side 2162 abuts the third side 2231, then the first protrusion block 216 pushes the second protrusion block 223. The first coupling member 220 rotates counterclockwise together with the first gear 210. The first coupling member 220 drives the third gear 320 to rotate counterclockwise via the second gear 310 and the second coupling member 330. The third gear 320 drives the two paper feeding wheels 110 to rotate clockwise via the plurality of transmitting gears 400. The two paper feeding wheels 110 feed individual sheets of paper into the printing apparatus 500 along a first direction.

When there is a sheet(s) of paper caught in the printing apparatus 500, these papers are caught between the two paper feeding wheels 110, the delay engaging member 200, the unidirectional engaging member 300 and the plurality of transmitting gears 400. The driving gear 120 rotates clockwise and drives the first gear 210 to rotate clockwise via the plurality of transmitting gears 400. When the first gear 210 rotates clockwise until the first side 2161 abuts the fourth side 2232, the caught papers are pulled out of the printing apparatus 500 in a second direction opposite to the first direction.

The two paper feeding wheels 110 rotate counterclockwise and drive the third gear 320 to rotate clockwise via the plurality of transmitting gears 400. The third gear 320 drives the first coupling member 220 to rotate clockwise via the second gear 310 and the second coupling member 330. As the first coupling member 220 is rotating clockwise (until the third side 2231 abuts the second side 2162), the first gear 210 is stationary in the printing apparatus 500. The driving gear 120 and the plurality of transmitting gears 400 are also stationary. Thus, any papers caught in the printing apparatus 500 can be pulled out easily, smoothly, and conveniently.

As the first gear 210 is rotating clockwise until the first side 2161 abuts the fourth side 2232, the first coupling member 220 is rotating clockwise together with the first gear 210. The slot 224 on the first coupling member 220 cannot engage with the second gear 310. The first coupling member 220 cannot drive the third gear 320 to rotate clockwise via the second gear 310 and the second coupling member 330. Therefore, any caught papers will not be caught further into the printing apparatus 500.

Even though numerous characteristics and advantages of the present disclosure have been set forth in the foregoing description, together with details of the structure and functions of the disclosure, the disclosure is illustrative only, and changes may be made in detail, especially in the matters of shape, size, and the arrangement of parts within the principles of the disclosure to the full extent indicated by the broad general meaning of the terms in which the appended claims are expressed.

What is claimed is:

1. A paper-feeding mechanism for a printing apparatus comprising:

a delay engaging member comprising a first gear and a first coupling member installed on the first gear; the first coupling member is adapted to rotate relative to the first gear; and an unidirectional engaging member comprising a third gear installed on the first coupling member; wherein when the printing apparatus works normally, the first gear rotates along a first direction, and the first coupling member and the third gear rotate along the first direction together with the first gear to transmit a paper in a second direction which is opposite to the first direction;

when the paper is jammed in the printing apparatus, the first gear rotates along the second direction, until the first gear abuts the first coupling member in the second direction; and the paper jammed in the printing apparatus is pulled along the first direction, the third gear and the first coupling member rotate along the second direction to avoid the first gear rotating together with the first coupling member until the paper jammed in the printing apparatus is pulled out.

2. The paper-feeding mechanism of claim 1, wherein the first direction is a counterclockwise direction and the second direction is a clockwise direction.

3. The paper-feeding mechanism of claim 1, wherein the unidirectional engaging member further comprises a second gear installed on the first coupling member, the first coupling member defines a slot thereon that corresponds to the second gear; when the first gear and the first coupling member rotate along the first direction, the slot on the first coupling member engages with the second gear, and the second gear rotates along the first direction and drives the third gear rotating along the first direction together with the third gear; when the first gear and the first coupling member rotate along the second direction, the slot on the first coupling member cannot engage with the second gear, and the second gear cannot rotate along the second direction and drive the third gear rotating along the second direction.

4. The paper-feeding mechanism of claim 3, wherein when the third gear rotates along the second direction, the third gear engages with the second gear, the second gear rotates along the second direction together with the third gear and engages with the slot on the first coupling member, and the first gear and the first coupling member rotate along the second direction together with the second gear; and when the third gear rotates along the first direction, the third gear engages with the second gear, the second gear rotates along the first direction together with the third gear and cannot engage with the slot on the first coupling member, and the first gear and the first coupling member cannot rotate along the first direction together with the second gear.

5. The paper-feeding mechanism of claim 2, wherein the first gear defines a first protrusion block thereon, the first coupling member defines a second protrusion block thereon, and the first gear rotates together with the first coupling member when the first protrusion block resists the second protrusion block.

6. The paper-feeding mechanism of claim 5, wherein the first gear comprises a circular shaped first body member, the first body member comprises a first surface and a second surface opposite to the first surface and a plurality of second teeth protrude from the first surface, a ring shaped rotating portion extends from the second surface and the first protrusion block extends from the second surface on one side of the rotating portion.

7. The paper-feeding mechanism of claim 6, wherein the first coupling member comprises a ring shaped second body member, the second body member defines a hollow cavity therein, the hollow cavity is adapted to accommodate the rotating portion therein and the second protrusion block extends from one side of the second body member.

8. The paper-feeding mechanism of claim 5, wherein the first protrusion block comprises a first side and a second side opposite to the first side, and the second protrusion block comprises a third side and a fourth side opposite to the third side; when the first gear rotates along the first direction until the second side abuts the third side, the first protrusion block pushes the second protrusion block and the first coupling member rotates along the first direction together with the first gear; and when the first gear rotates along the second direction until the first side abuts the fourth side, the first protrusion block pushes the second protrusion block and the first coupling member rotates along the second direction together with the first gear.

9. The paper-feeding mechanism of claim 8, wherein when the printing apparatus works normally, the first gear rotates along the first direction until the second side abuts the third side, and the first coupling member rotates along the first direction together with the first gear; and when the paper is pulled along the first direction, the first gear rotates along the second direction until the first side abuts the fourth side, and the third gear drives the first coupling member rotating along the second direction until the paper jammed in the printing apparatus is pulled out.

10. The paper-feeding mechanism of claim 3, wherein the unidirectional engaging member further comprises a second coupling member installed between the first coupling member and the third gear, and the first coupling member is adapted to drive the third gear rotating via the second gear and the second coupling member.

11. A paper-feeding mechanism for a printing apparatus comprising:

a delay engaging member comprising a first gear and a first coupling member installed on the first gear; the first coupling member is adapted to rotate relative to the first gear; and a unidirectional engaging member comprising a second gear and a third gear installed on the first coupling member; the first coupling member defines a slot thereon for engaging with the second gear; wherein when the printing apparatus works normally, the first gear rotates along a first direction, and the first coupling member and the third gear rotate along the first direction together with the first gear to transmit a paper in a second direction which is opposite to the first direction; when the paper is jammed in the printing apparatus, the first gear rotates along the second direction until the first gear abuts the first coupling member in the second direction; and the paper jammed in the printing apparatus is pulled along the first direction, the third gear and the first coupling member rotate along the second direction to avoid the first gear rotating together with the first coupling member until the paper jammed in the printing apparatus is pulled out.

12. The paper-feeding mechanism of claim 11, wherein when the first gear and the first coupling member rotate along the first direction, the slot on the first coupling member engages with the second gear and the second gear rotates along the first direction and drive the third gear rotating along the first direction together with the third gear, and when the first gear and the first coupling member rotate along the second direction, the slot on the first coupling member cannot engage with the second gear and the second gear cannot rotate along the second direction and drive the third gear rotating along the second direction.

13. The paper-feeding mechanism of claim 12, wherein when the third gear rotates along the second direction, the third gear engages with the second gear, the second gear rotates along the second direction together with the third gear and engages with the slot on the first coupling member, and the first gear and the first coupling member rotate along the second direction together with the second gear, and when the third gear rotates along the first direction, the third gear engages with the second gear; the second gear rotate along the first direction together with the third gear and cannot engage with the slot on the first coupling member, and the first gear and the first coupling member cannot rotate along the first direction together with the second gear.

14. The paper-feeding mechanism of claim 12, wherein the first gear defines a first protrusion block thereon, the first coupling member defines a second protrusion block thereon and the first gear rotates together with the first coupling member when the first protrusion block resists the second protrusion block.

15. The paper-feeding mechanism of claim 14, wherein the first gear comprises a circular shaped first body member, the first body member comprises a first surface and a second surface opposite to the first surface and a plurality of second teeth protrude from the first surface, a ring shaped rotating portion extends from the second surface and the first protrusion block extends from the second surface on one side of the rotating portion.

16. The paper-feeding mechanism of claim 15, wherein the first coupling member comprises a ring shaped second body member, the second body member defines a hollow cavity therein, the hollow cavity is adapted to accommodate the rotating portion therein and the second protrusion block extends from one side of the second body member.

17. The paper-feeding mechanism of claim 14, wherein the first protrusion block comprises a first side and a second side opposite to the first side and the second protrusion block comprises a third side and a fourth side opposite to the third side, when the first gear rotates along the first direction until the second side abuts the third side, the first protrusion block pushes the second protrusion block and the first coupling member rotates along the first direction together with the first gear, and when the first gear rotates along the second direction until the first side abuts the fourth side, the first protrusion block pushes the second protrusion block and the first coupling member rotates along the second direction together with the first gear.

18. The paper-feeding mechanism of claim 17, wherein when the printing apparatus works normally, the first gear rotates along the first direction until the second side abuts the third side and the first coupling member rotates along the first direction together with the first gear, and when the paper is pulled along the first direction, the first gear rotates along the second direction until the first side abuts the fourth side and the third gear drives the first coupling member rotating along the second direction until the paper jammed in the printing apparatus is pulled out.

19. The paper-feeding mechanism of claim 11, wherein the first direction is a counterclockwise direction and the second direction is a clockwise direction.

20. The paper-feeding mechanism of claim 11, wherein the unidirectional engaging member further comprises a second coupling member installed between the first coupling member and the third gear and the first coupling member is adapted to drive the third gear rotating via the second gear and the second coupling member.

* * * * *